US007296302B2

(12) United States Patent
DeLorenzo et al.

(10) Patent No.: US 7,296,302 B2
(45) Date of Patent: Nov. 20, 2007

(54) HOODED GARMENT WITH BUILT-IN SKULL CAP, GLOVES, AND LOWER FACE COVERING WITH MOUTH OPENING

(76) Inventors: Tim Louis DeLorenzo, 281 Houses Corner Rd., Lafayette, NJ (US) 07848; Scott Patrick DeLorenzo, 281 Houses Corner Rd., Lafayette, NJ (US) 07848

( * ) Notice: Subject to any disclaimer, the term of this patent is extended or adjusted under 35 U.S.C. 154(b) by 50 days.

(21) Appl. No.: 11/081,941

(22) Filed: Jun. 27, 2005

(65) Prior Publication Data

US 2006/0288465 A1 Dec. 28, 2006

(51) Int. Cl.
*A42B 1/22* (2006.01)

(52) U.S. Cl. ..... 2/84; 2/202

(58) Field of Classification Search ..... 2/84–90, 2/93–98, 102, 206, 123, 125, 159, 160, 202
See application file for complete search history.

(56) References Cited

U.S. PATENT DOCUMENTS

| | | | | | |
|---|---|---|---|---|---|
| 1,097,530 | A | * | 5/1914 | Cabelinsky | 2/84 |
| 2,274,510 | A | * | 2/1942 | Wohl et al. | 2/270 |
| 2,839,757 | A | * | 6/1958 | Gianola | 2/205 |
| 3,214,771 | A | * | 11/1965 | Treiber | 2/270 |
| 3,696,474 | A | * | 10/1972 | Slauta | 2/84 |
| 4,573,217 | A | * | 3/1986 | Reed | 2/7 |
| 5,115,517 | A | * | 5/1992 | Ferguson et al. | 2/203 |
| 5,125,117 | A | * | 6/1992 | Buenos et al. | 2/239 |
| 5,251,336 | A | * | 10/1993 | Nevins | 2/202 |
| 5,615,416 | A | * | 4/1997 | Haddad | 2/202 |
| 5,704,068 | A | * | 1/1998 | Martin | 2/173 |
| 5,713,077 | A | * | 2/1998 | Humbrecht | 2/173 |
| 5,845,340 | A | * | 12/1998 | Frislie | 2/202 |
| 5,918,314 | A | * | 7/1999 | Moses | 2/79 |
| D430,721 | S | * | 9/2000 | Beauchan | D2/825 |
| 6,253,381 | B1 | * | 7/2001 | Kelley | 2/125 |
| 6,397,395 | B1 | * | 6/2002 | DeHart | 2/206 |
| 6,425,138 | B1 | * | 7/2002 | Johnson | 2/202 |
| 6,665,878 | B1 | * | 12/2003 | Way | 2/84 |
| 6,789,266 | B1 | * | 9/2004 | Mills et al. | 2/172 |
| 2003/0154536 | A1 | * | 8/2003 | Anderson et al. | 2/108 |
| 2004/0187186 | A1 | * | 9/2004 | Boezi | 2/84 |
| 2005/0160514 | A1 | * | 7/2005 | Flaniken | 2/84 |

FOREIGN PATENT DOCUMENTS

GB 2253776 A * 9/1992

* cited by examiner

*Primary Examiner*—Alissa Hoey
(74) *Attorney, Agent, or Firm*—Notaro & Michalos PC

(57) ABSTRACT

A garmet has a hood with an inside front base and a pair of lower front hood portions each having upper and lower projections projecting toward the other lower front hood portion and a securing device connected to each of the projections for connecting the lower projections to each other across a user's face and respectively above and below the user's mouth so that a recess is defined of a size to expose the mouth. When the projections are connected to each other the user will not breath onto the lower front hood portions. A skull cap has a rear lower edge connected to the inside front base of the hood and sleeves with storable gloves can also be included as part of the garmet.

11 Claims, 4 Drawing Sheets

HOODED GARMENT WITH BUILT-IN SKULL CAP, GLOVES, AND LOWER FACE COVERING WITH MOUTH OPENING

BACKGROUND OF THE INVENTION (1) Field of the Invention

The present invention is a hooded garment with built-in skull cap, lower face covering with mouth opening, and built-in gloves.

(2) Description of the Related Art

Various types of previously introduced hooded garments have been geared primarily toward either functionality or fashionability. The singular aspect of the current invention is the dual focus on both functionality and casual fashionability.

Additionally, various types of hoods, skull caps, and gloves have been previously introduced separately for either functionality or fashionability. The hood, skull cap, and gloves of the current invention combine to form one functional and casually fashionable garment.

SUMMARY OF THE INVENTION

One object of the current invention is to provide a casual garment that also doubles as a functional, inclement weather-friendly garment. Three main options are available: 1) a built-in skull cap, 2) lower face covering with mouth opening, and 3) built-in gloves. The garment can be worn without employing any of the three main options. It can also be worn while employing all three options simultaneously. Additionally, any one or two of the three options may be employed at any given time without employing the other(s).

DESCRIPTION OF THE PREFERRED EMBODIMENTS

Figure 1A:
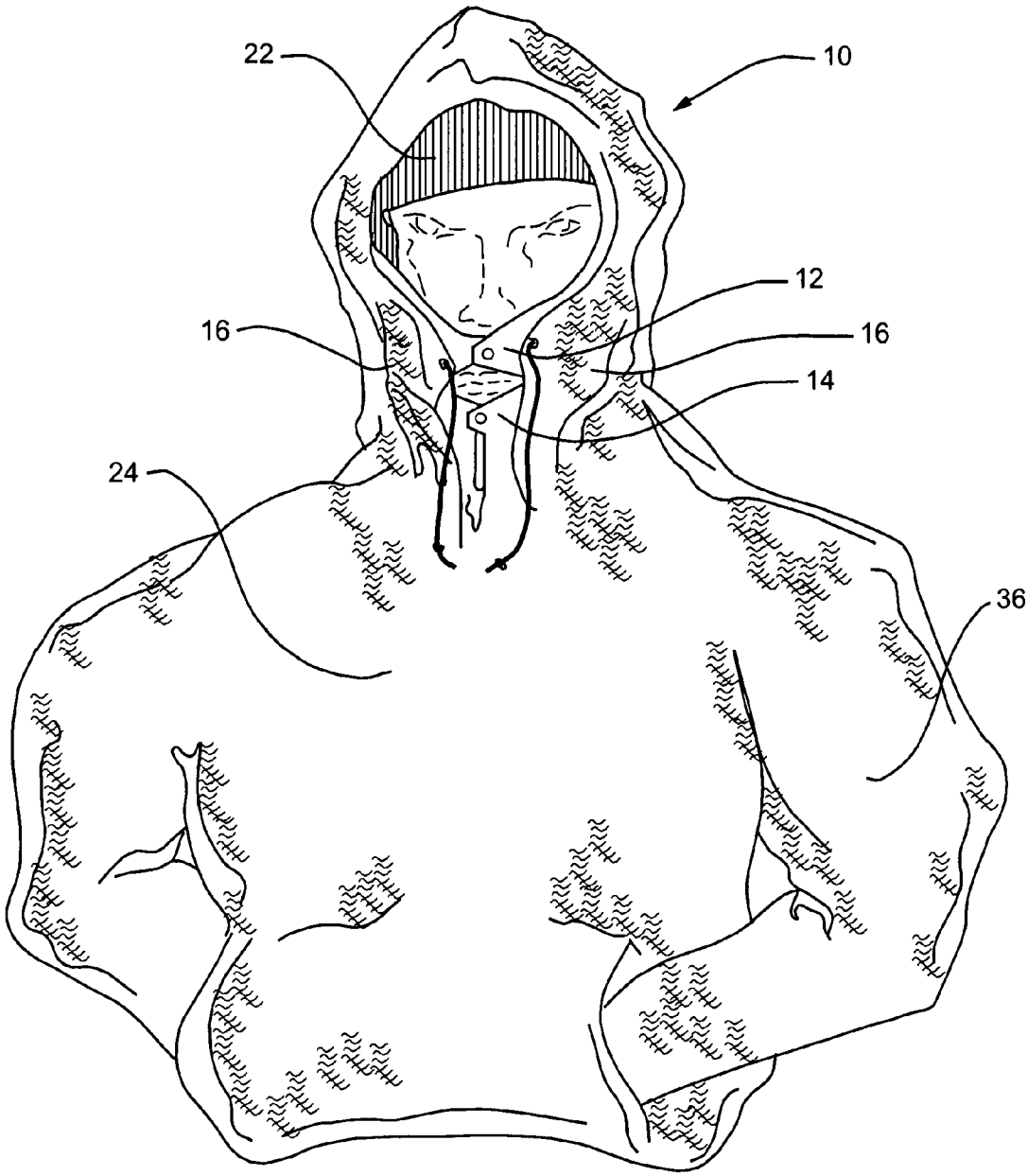
FIG. 1A is a front elevational view of the hooded garment of the present invention.
Figure 1B:
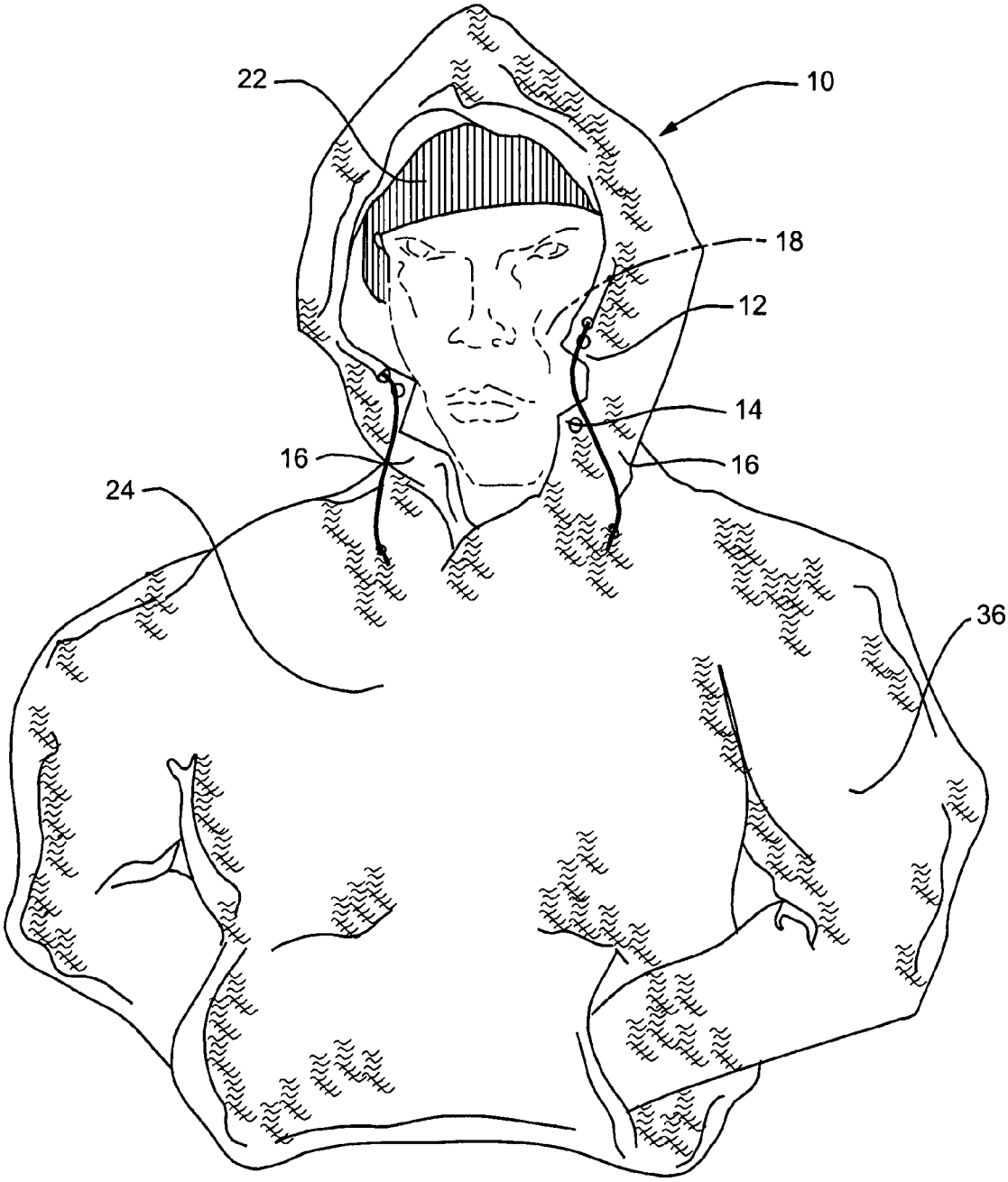
FIG. 1B is a view similar to FIG. 1A of the garment with a lower portion of the hood open.
Figure 2A:
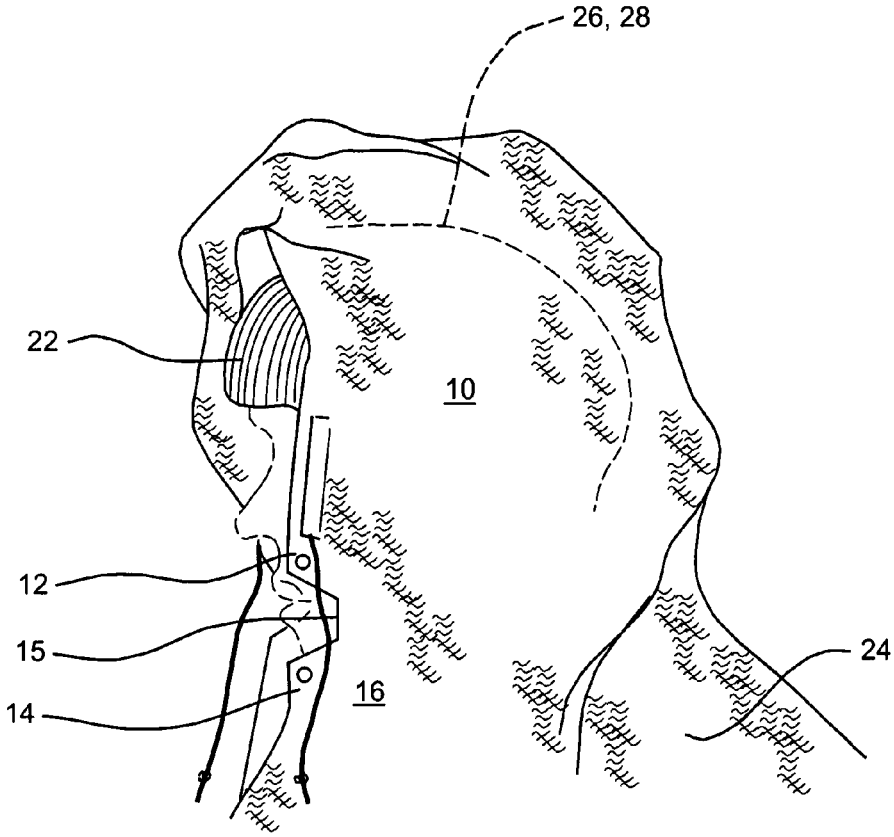
FIG. 2A is a side view of the hood and a skull cap of the invention in a covering but open position.

It is another object of the current invention to allow for the use of a unique lower face covering for protection from inclement weather while maintaining comfort. As shown in FIGS. 1A and 1B, two sets of corresponding snaps, buttons, hook-and-loop fasteners (e.g. Velcro brand fasteners—Velcro being a trademark) or other securing devices 12 and 14 are provided near the ends of two pairs of projections located at each of the front, lower portions 16 of the hood 10 near the user's cheeks 18, which when pulled together and secured, cover the lower face and chin while leaving an opening 20 for the user's mouth. Opening 20 is formed by a pair of recesses 15 provided on each lower, front hood portion 16, between the upper and lower projections with their securing devices 12 and 14 on each lower, front hood portion 16 as best shown in FIG. 2A. The usual discomfort around the mouth area usually associated with masks and face coverings is not present in the current invention because of the created mouth opening 20, which allows the wearer to breathe freely without coping with any covering material. Contingent upon the material and size of the garment, the area of the garment or hood portions where the securing devices 12 and 14 are located may need to include a certain percentage of elastic-type material so as to allow the securing devices to attach to one another, thereby stretching the material across the user's lower face and chin. As shown in FIGS. 1A and 1B, the garment 24 includes a body covering portion connected to the hood 10 for covering the shoulders and the chest of a user using the garment.

Figure 2B:
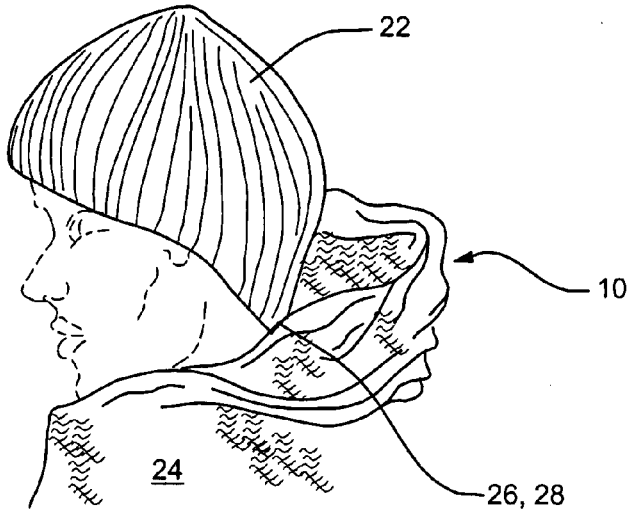
FIG. 2B is a view similar to FIG. 2A but with the hood down.

It is still another object of the current invention to allow for the use of a skull cap 22 which is permanently fixed near its lower rear edge 26, via stitching or other fixing method to the inside front of the base 28 of the hood 10 of the garment 24, thus positioning the skull cap 22 in front of the hood 10 so as to allow A) the skull cap 22 to be worn alone as shown in FIG. 2B, B) the hood 10 to be worn alone, or C) both the skull cap 22 and hood 10 to be worn in conjunction as shown in FIGS. 1A, 1B and 2A. The inside front base 28 of the hood is behind the user's neck when the garment is being used. When the skull cap is not in use, it can be stored in various ways. One such storage option is using opposite pieces of Velcro brand hook-and-loop fastener, one adhered to the back of the skullcap and one adhered to the inside lining of the hood so as to allow the skullcap to be temporarily attached to the inside lining of the hood. Another such storage option is tucking the skullcap downward into a pocket on the inside and back of a permanently attached garment, thereby completely clearing the skullcap from the head area.

Figure 3A:
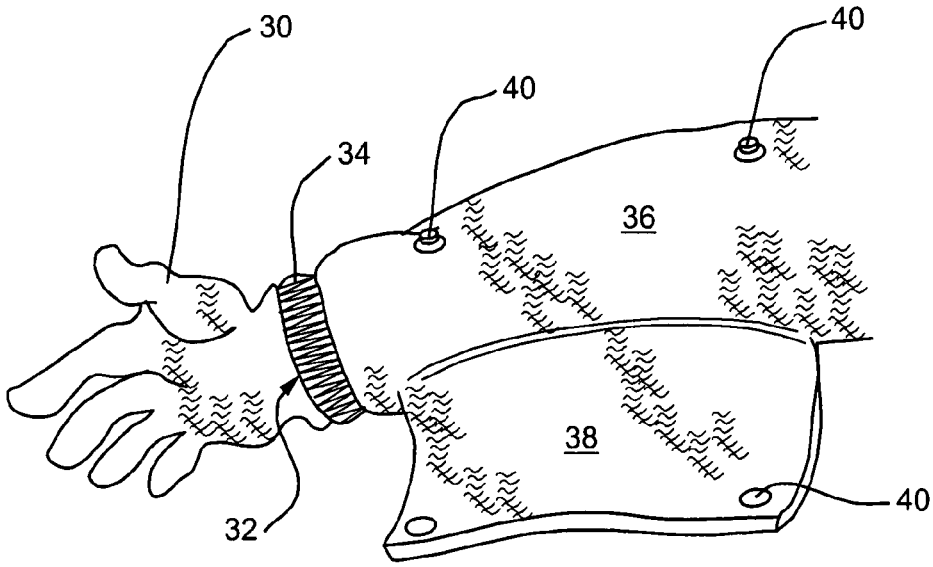
FIG. 3A is a perspective view of one sleeve of the garment with a a glove in a use position over the hand of a user.
Figure 3B:
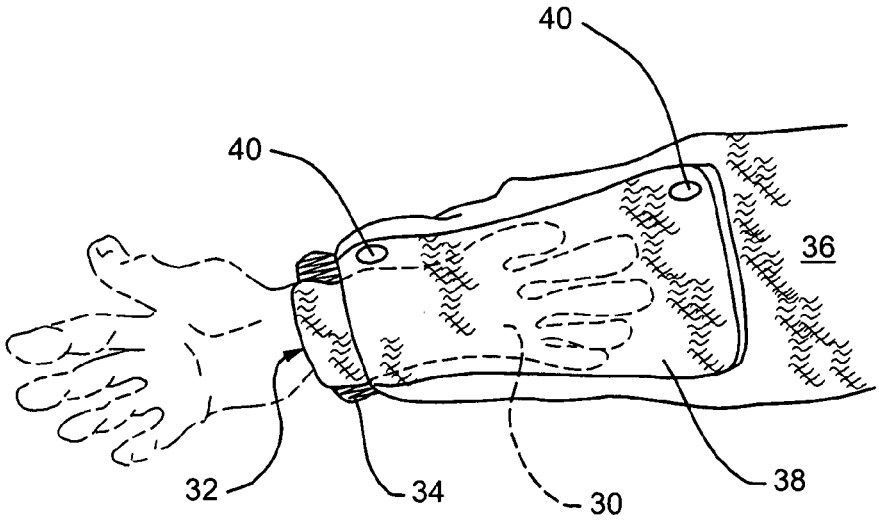
FIG. 3B is a view similar to FIG. 3A of the glove in a stored position.

It is yet another object of the current invention, as shown in FIG. 3A and 3B to allow for the use of gloves 30 permanently attached at an outer edge 32 to the sleeve cuffs 34 of the sleeve 36 of the garment 24, whereby the gloves can either be A) worn as in FIG. 3A or B) not worn as in FIG. 3B. The attached gloves can be stored in a number of ways when not being worn. One such storage option is to tuck each glove into a pocket on the inside or outside of the corresponding sleeve. Another such storage option is to fold each glove back onto the sleeve 36 and cover it with a flap 38 of material permanently fixed with stitching or other fixing method along one edge to the garment sleeve 36 and secure the other edge of the material to the sleeve with snaps, buttons, Velcro brand or other securing devices 40.

The invention claimed is:

1. A garment for covering at least part of the head and face of a user, comprising:

a hood having a head covering position for covering the head of a user, and a lowered position, the hood having an inside front base for being behind the neck of the user when the garment is used;

the hood including a pair of lower front hood portions each having a face covering position for covering a lower portion of the face of a user using the garment, and an open position for exposing the face of a user using the garment;

each lower front hood portion having upper and lower projections projecting toward the other lower front hood portion;

a securing device connected to each upper and lower projection of each lower front hood portion for connecting the upper projections to each other over the mouth of a user using the garment and for connecting the lower projections to each other under the mouth of a user using the garment;

each of the lower front hood portions including a recess between the upper and the lower projection thereof, each recess being of a size to expose the mouth of a user using the garment when the hood is in the head covering position, the lower front hood portions are in the face covering position, and the upper and lower projections are connected to each other so that a user using the garment will not breathe onto the lower front hood portions; and a skull cap having a rear lower edge connected to the inside front base of the hood for covering the head of a user using the garment, with and without the hood being in the head covering position, and for being stored in the hood when the skull cap is not covering the head of the user.

2. A garment according to claim 1, wherein the projections each are at least partly made of elastic material so that the projections stretch across the face of a user using the garment when the upper and lower projections are connected respectively to each other.

3. A garment according to claim 1, wherein the garment includes a body covering portion connected to the hood for covering the shoulders and chest of a user using the garment.

4. A garment according to claim 1, wherein the garment includes a body covering portion connected to the hood for covering the shoulders and chest of a user using the garment, a pair of sleeves with cuffs connected to the body covering portion, and a glove connected to each of the pair of cuffs, each sleeve including a glove covering flap near the cuff for defining a pocket for storing each glove, and at least one securing device connected to each flap for keeping each respective pocket closed.

5. A garment according to claim 1, wherein the projections each are at least partly made of elastic material so that the projections stretch across the face of a user using the garment when the upper and lower projections are connected to each other, the garment including a body covering portion connected to the hood for covering the shoulders and chest of a user using the garment, a pair of sleeves with cuffs connected to the body covering portion, and a glove connected to each of the pair of cuffs, each sleeve including a glove covering flap near the cuff for defining a pocket for storing each glove, and at least one further securing device connected to each flap for keeping each respective pocket closed.

6. A garment according to claim 1, wherein the securing devices are selected from the group comprising: snaps, buttons and hook-and-loop fasteners.

7. A garment for covering at least part of the head and face of a user, comprising:

a hood having a head covering position for covering the head of a user, and a lowered position;

the hood including a pair of lower front hood portions each having a face covering position for covering a lower portion of the face of a user using the garment, and an open position for exposing the face of a user using the garment;

each lower front hood portion having upper and lower projections projecting toward the other lower front hood portion;

a securing device connected to each of the upper and lower projections of each of the lower front hood portions for connecting the upper projections to each other and for connecting the lower projections to each other; and each of the lower front hood portions including a recess between the upper and the lower projection thereof, each recess being of a size to expose the mouth of a user using the garment when the hood is in the head covering position, the lower front hood portions are in the face covering position, and the upper and lower projections are connected to each other so that a user using the garment will not breathe unto the lower front hood portions, the garment including a body covering portion connected to the hood for covering the shoulders and chest of a user using the garment, a pair of sleeves with cuffs connected to the body covering portion, and a glove connected to each of the pair of cuffs, each sleeve including a glove covering flap near the cuff for defining a pocket for storing each glove, and at least one securing device connected to each flap for keeping each respective pocket closed.

8. A garment according to claim 7, wherein the projections each are at least partly made of elastic material so that the projections stretch across the face of a user using the garment when the upper and lower projections are connected respectively to each other.

9. A garment according to claim 7, wherein the garment includes a body covering portion connected to the hood for covering the shoulders and chest of a user using the garment.

10. A garment for covering at least part of the head and face of a user, comprising:

a hood having a head covering position for covering the head of a user, and a lowered position;

the hood including a pair of lower front hood portions each having a face covering position for covering a lower portion of the face of a user using the garment, and an open position for exposing the face of a user using the garment;

each lower front hood portion having upper and lower projections protecting toward the other lower front hood portion;

a securing device connected to each of the upper and lower projections of each of the lower front hood portions for connecting the upper projections to each other and for connecting the lower projections to each other; and each of the lower front hood portions including a recess between the upper and the lower projection thereof, each recess being of a size to expose the mouth of a user using the garment when the hood is in the head covering position, the lower front hood portions are in the face covering position, and the upper and lower projections are connected to each other so that a user using the garment will not breathe unto the lower front hood portions, the projections each being at least partly made of elastic material so that the projections stretch across the face of a user using the garment when the upper and lower projections are connected to each other, the garment including a body covering portion connected to the hood for covering the shoulders and chest of a user using the garment, a pair of sleeves with cuffs connected to the body covering portion, and a glove connected to each of the pair of cuffs, each sleeve including a glove covering flap near the cuff for defining a pocket for storing each glove, and at least one securing device connected to each flap for keeping each respective pocket closed.

11. A garment according to claim 7, wherein the securing devices are selected from the group comprising: snaps, buttons and hook-and-loop fasteners.

* * * * *